US005374230A

United States Patent [19]

Bonnaime

[11] Patent Number: 5,374,230

[45] Date of Patent: Dec. 20, 1994

[54] MUSCLE STRETCHING APPARATUS

[76] Inventor: Bruno G. J. Bonnaime, 59, avenue Emile Zola 75015, Paris, France

[21] Appl. No.: 101,992

[22] Filed: Aug. 4, 1993

[51] Int. Cl.[5] ..... A63B 21/008; A63B 23/04

[52] U.S. Cl. ..... 482/112; 482/907; 482/138; 482/142; 482/145; 601/35

[58] Field of Search ..... 482/142, 145, 907, 130, 482/133, 134, 138, 112, 95, 110, 113, 137, 146; 601/34, 35

[56] References Cited

U.S. PATENT DOCUMENTS

| | | | |
|---|---|---|---|
| 4,240,627 | 12/1980 | Brentham . | |
| 4,452,447 | 6/1984 | Lepley et al. | 482/113 |
| 4,834,072 | 5/1989 | Goodman | 482/142 |
| 4,844,453 | 7/1989 | Hestilow . | |
| 4,930,497 | 6/1990 | Sarwyer | 601/34 |
| 4,986,261 | 1/1991 | Ians et al. | 601/5 |
| 5,254,067 | 10/1993 | Habing et al. | 482/137 |
| 5,277,681 | 1/1994 | Holt | 482/138 |

FOREIGN PATENT DOCUMENTS

| | | |
|---|---|---|
| 2357236 | 4/1980 | France . |
| 2614794 | 5/1987 | France . |

*Primary Examiner*—Richard J. Apley
*Assistant Examiner*—Lynne A. Reichard
*Attorney, Agent, or Firm*—Jones & Askew

[57] ABSTRACT

Muscle stretching apparatus characterized in that it comprises a support structure (3) mounted so as to pivot on a frame (1) by means of a pin (2), this support (3) being provided with means ($5_1$, $5_2$) for supporting the two legs of the user, these means being mounted on the support by means of pivot pins ($4_1$, $4_2$, which are perpendicular to the pin (2) on which the support (3) pivots on the frame (1), this frame including a support platform of adjustable height, the arrangement of the three rotation pins (2, $4_1$ and $4_2$) making it possible to position the physiological joint axes of the individual in alignment with the pins of the machine, regardless of the movement performed and the morphology of the individual.

7 Claims, 3 Drawing Sheets

11

MUSCLE STRETCHING APPARATUS

The apparatus of the invention is characterized in that it comprises a support structure mounted so as to pivot on a frame by means of a pin, this support being provided with means for supporting the two legs of the user, these means being mounted on the support by means of pivot pins which are perpendicular to the pin on which the support pivots on the frame.

According to another feature of the invention, the means for supporting the two legs of the user comprise two panels each mounted so as to pivot on the support by means of a pin which is perpendicular to the pin on which the support pivots on the frame, these panels being parallel to the pin on which the support pivots on the frame.

According to another feature of the invention, each panel is provided with a sole plate which can move perpendicularly to the panel, this sole plate being parallel to the pin on which the support pivots on the frame.

The invention is represented by way of a non-limiting example in the appended drawings in which:

DESCRIPTION OF PREFERRED EMBODIMENT

Figure 1:
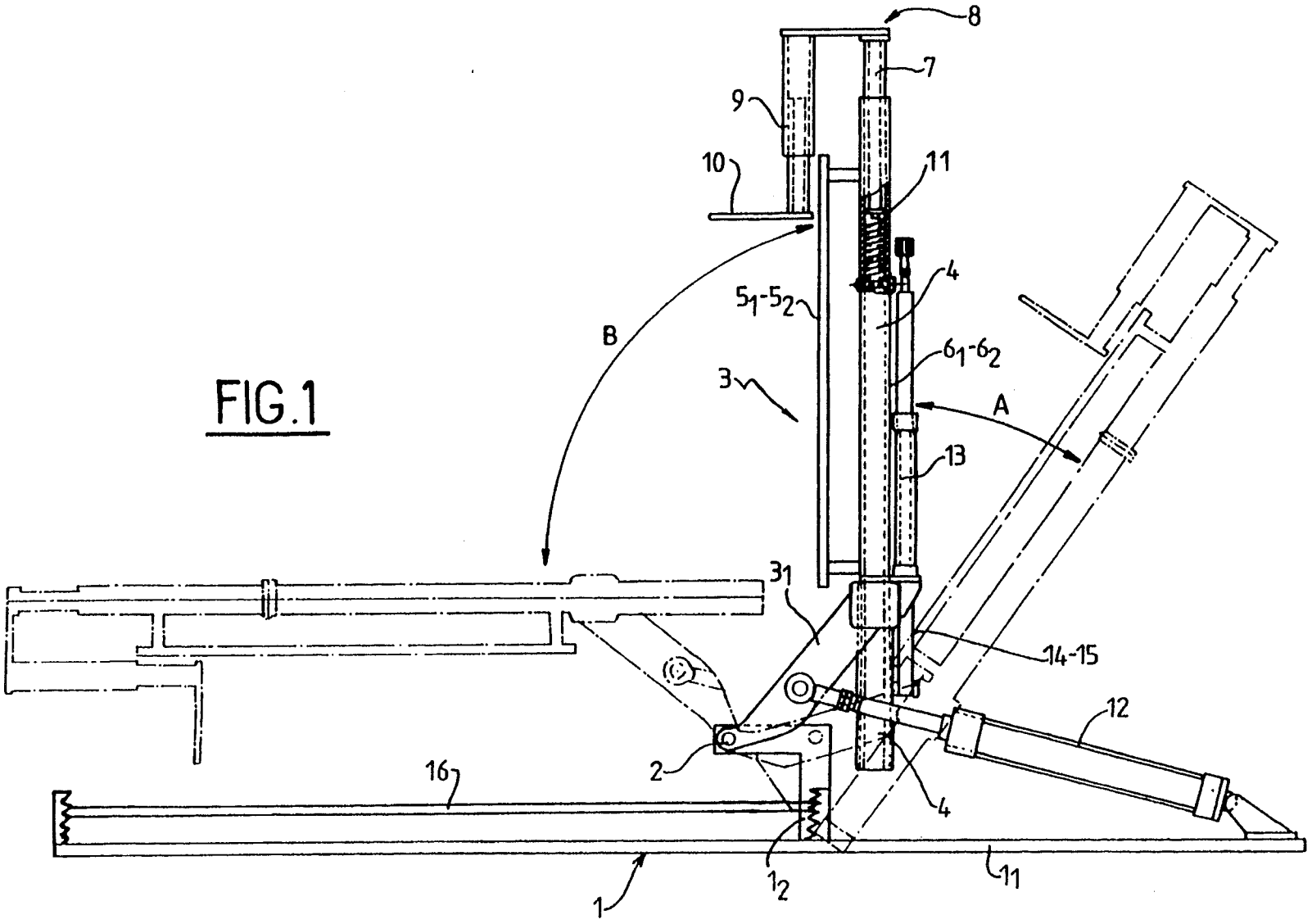
FIG. 1 is a side view of one embodiment of the invention.
Figure 2:
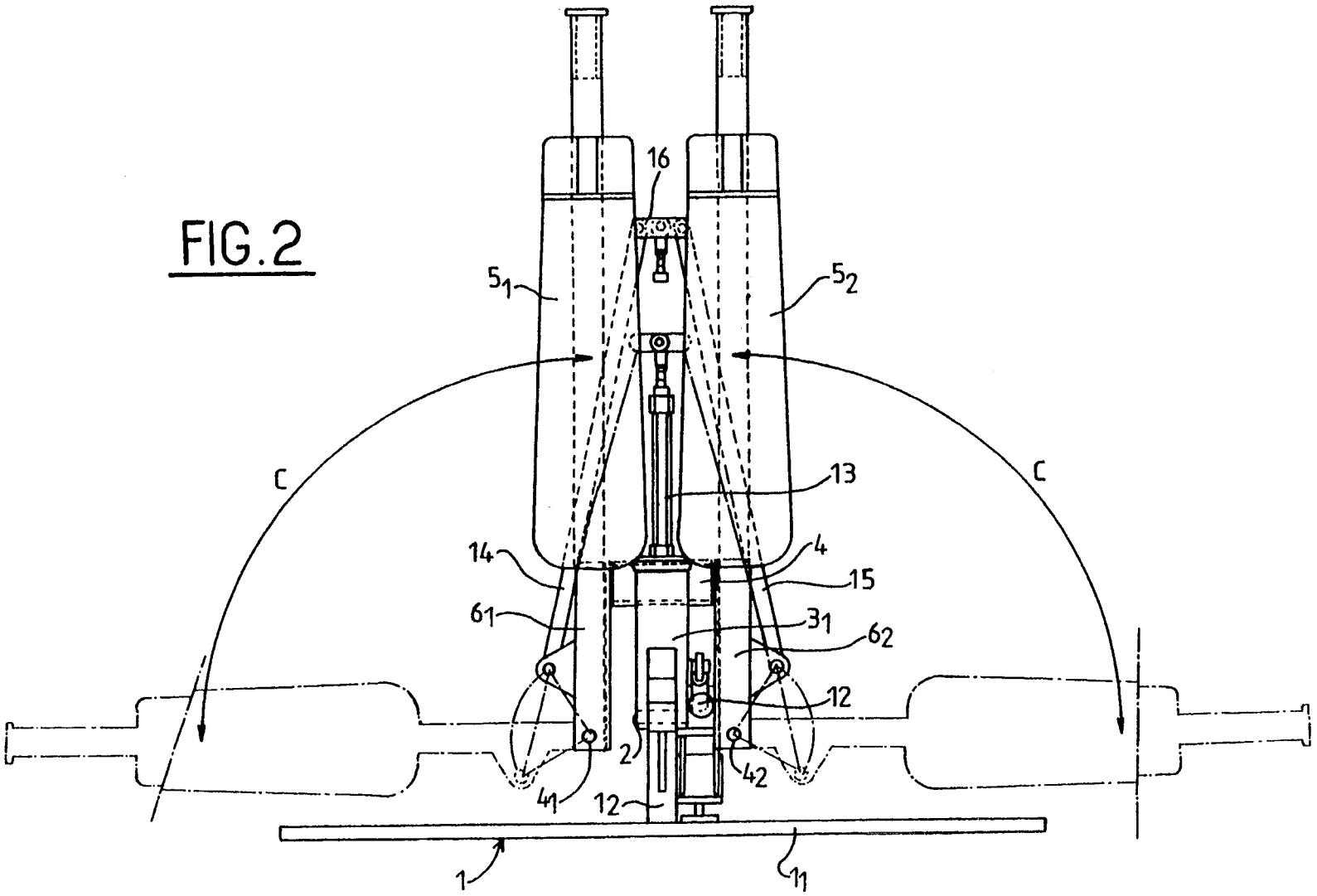
FIG. 2 is a view from the left of FIG. 1.
Figure 3:
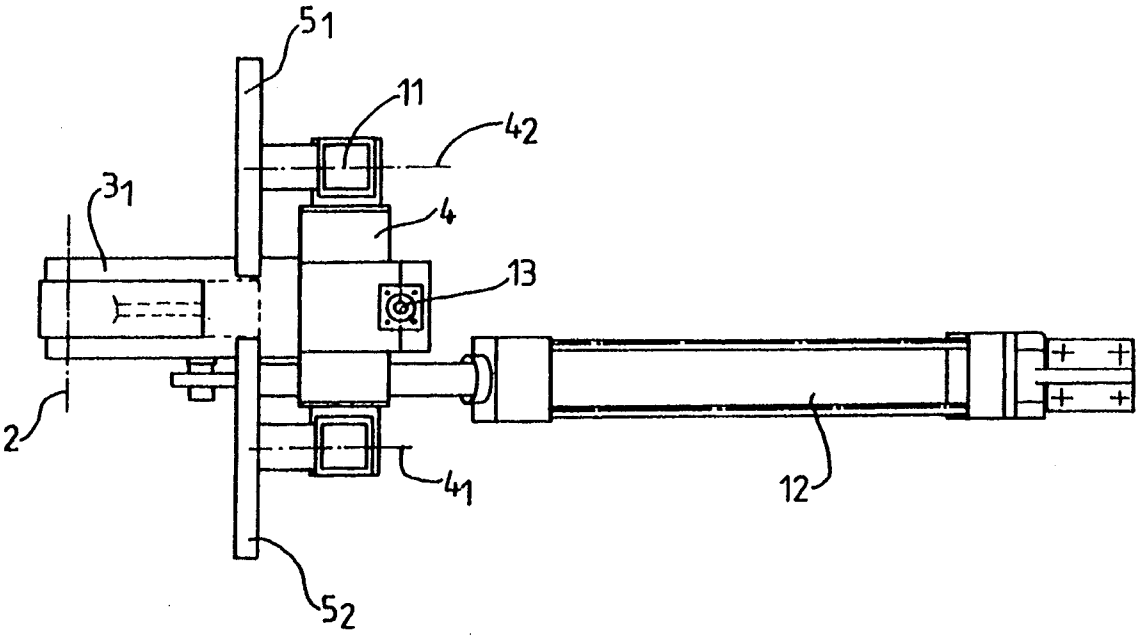
FIG. 3 is a plan view of FIG. 1.

The apparatus of the invention comprises a frame 1 itself composed of a base plate $1_1$ on which there is fixed an angle bracket $1_2$. A support 3 is mounted so as to pivot on this angle bracket $1_2$ by means of a pin 2. This support 3 comprises an arm $3_1$ receiving the pivot pin 2 and to which there is also fixed a U-shaped structure 4 the end of the branches of which includes pivot pins $4_1$, $4_2$ for elongate panels $5_1$, $5_2$ intended to act as a support for the legs of the user.

These pins $4_1$ and $4_2$ are oriented perpendicularly to the pivot pin 2 of the support 3.

The panels $5_1$, $5_2$ which are parallel to the pin 2, are each connected to a pivot pin $4_1$, $4_2$ by a tubular section $6_1$, $6_2$. Inside this section $6_1$, $6_2$ there is slidingly mounted a section 7 forming one of the branches of a U-shaped structure 8 the upper branch 9 of which also receives, in an adjustable manner, a sole plate 10 arranged perpendicularly to the panels $5_1$ and $5_2$ and parallel to the pin 2.

A spring 11 is hooked on the one hand to the inside of the sections $6_1$, $6_2$ and, on the other hand, to the end of the section 7 in order constantly to tend to make the sole plate 10 slide towards the base plate $1_1$.

Arrangements will moreover be provided to make it possible to adjust the height of the pins $4_1$, $4_2$ in order precisely to match the position of these pins to the height of the hips of the user so that they correspond to the position of the anatomical axes of the operator.

This adjustment may for example be obtained by adjusting the height of the pins $4_1$ and $4_2$ on the U-shaped structure 4 or by arranging a support panel 16 of adjustable height on the frame 1.

Also in this construction, the relative position and the distance of the perpendicular pins 2 and $4_1$, $4_2$ will be defined so that they are coincident with the axes of the hip joints regardless of the movement performed and of the morphology of the individual and due to the adjustment of the height of the pins $4_1$ and $4_2$ described previously.

Means will also be provided for producing a force for resisting the pivoting or, in contrast, a driving force for pivoting the support 3 about its pin 2 and the panels $5_1$, $5_2$ about their pins $4_1$, $4_2$.

These means will preferably consist of hydraulic, pneumatic, or spring-loaded thrust cylinders. In the case of pneumatic or hydraulic thrust cylinders a control mechanism, not shown, will be provided, which can be operated by the user in order to define the starting and finishing angles as well as the force and the distribution of this force in the driving and/or resistive pivoting cycle of the support 3 and/or of the panels $5_1$, $5_2$.

According to the example shown in the drawings, these thrust cylinders comprise a first thrust cylinder 12 connecting the arm $3_1$ of the support 3 to the base plate $1_1$ and a thrust cylinder 13 connecting the base of the U-shaped structure 4 to oblique arms 14 and 15 and to the sections $6_1$, $6_2$ by means of a transmission bar 16.

In operation, the user stretched out on his back initially places one of his legs on one of the panels $5_1$, $5_2$, the other leg being stretched out on the ground. The user then exerts a force as indicated by the arrow A, with the panel $5_1$ or $5_2$ remaining unmoved.

After this muscular thrust effort, the thrust cylinder 12 generates a force in the opposite direction, in the direction of the arrow B, tending to bring the panels $5_1$, $5_2$ into a horizontal position in order to stretch out the posterior muscles in the thigh.

These movements, repeated for one of the legs, are then performed by the other leg by implementing the other panel $5_1$ or $5_2$.

It will be noted that during all these movements, the sole plates $10_1$ which are mounted so as to slide under the action of springs 11 exert a pressure on the heels of the operator in order to keep his pelvis pressed against the base $1_1$.

The second series of movements will be obtained by placing the two legs against the panels $5_1$, $5_2$, the apparatus having previously been adjusted so as to arrange the pins $4_1$, $4_2$ not only at the height of the hips of the user.

The movements to be performed consist in making the panels $5_1$, $5_2$ pivot outwards by an angle of 90° in the direction of the arrows C by generating a force opposing or accompanying the resistive or driving force created by the thrust cylinder 13.

These movements have the particular effect of building up the muscles on the internal face of the thigh and then of stretching out these same muscles.

These pivoting movements in the directions of the arrows C may be performed with any angular position whatsoever of the panels $5_1$, $5_2$ in the directions of the arrows A or B.

I claim:

1. Muscle stretching apparatus comprising:

a support (3) mounted so as to pivot on a frame by a first pivot pin (2);

the supporting provided with means for supporting the two legs of the user, the supporting means being mounted on the support by second and third pivot pins ($4_1$, $4_2$) which are perpendicular to said first pivot pin on which the support pivots on the frame: and a support platform (16) of adjustable height on the frame for supporting the body of the user in adjustable relation to the three pivot pins (2, $4_1$ and $4_2$), making it possible to position the physiological joint axes of the individual in alignment with said pivot pins of the machine, regardless of the movement performed and the morphology of the body of the individual user.

2. Apparatus in accordance with claim 1, wherein the means for supporting the two legs of the user comprise two panels each mounted so as to pivot to the support (3) by means of said second and third pivot pins which are perpendicular to the first pivot pin on which the support pivots on the frame, these panels being parallel to said first pivot pin.

3. Apparatus in accordance with claim 2, wherein each panel is provided with a sole plate which can move perpendicularly to the panel, this sole plate being parallel to the said first pivot pin on which the support pivots on the frame.

4. Apparatus in accordance with claim 3, characterized in that each sole plate can move under the action of a spring.

5. Apparatus in accordance with claim 2, characterized in that the panels are pivotally connected by two oblique arms articulated one on the other.

6. Muscle stretching apparatus comprising:

a support mounted so as to pivot on a frame by means of a first pivot pin (2);

the support being provided with two panels ($5_1$, $5_2$) for supporting the two legs of the user, these panels being mounted on the support by pivot pins ($4_1$, $4_2$) which are perpendicular to said first pivot pin (2) on which the support pivots on the frame;

the frame including a support platform of adjustable height, the arrangement of the three pivot pins (2, $4_1$ and $4_2$) making it possible to position the physiological joint axes of the individual user in alignment with said pivot pins of the machine, regardless of the movement performed and the morphology of the individual user; and each panel ($5_1$, $5_2$) is provided with a sole plate (10) which can move perpendicularly to the panel, these sole plates being parallel to said first pivot pin (2) on which the support pivots on the frame.

7. Apparatus in accordance with claim 6, characterized in that each sole plate (10) can move under the action of a spring (11).

* * * * *